US008893886B2

(12) United States Patent
Tsukaguchi

(10) Patent No.: US 8,893,886 B2
(45) Date of Patent: Nov. 25, 2014

(54) STAND FOR HEXAGON SOCKET SCREW KEYS

(76) Inventor: Tomotsugu Tsukaguchi, Kyoto (JP)

( * ) Notice: Subject to any disclaimer, the term of this patent is extended or adjusted under 35 U.S.C. 154(b) by 0 days.

(21) Appl. No.: 13/810,123

(22) PCT Filed: Jul. 8, 2011

(86) PCT No.: PCT/JP2011/065682

§ 371 (c)(1),
(2), (4) Date: Jan. 14, 2013

(87) PCT Pub. No.: WO2012/008377

PCT Pub. Date: Jan. 19, 2012

(65) Prior Publication Data

US 2013/0112635 A1 May 9, 2013

(30) Foreign Application Priority Data

Jul. 14, 2010 (JP) ..... 2010-159450

(51) Int. Cl.

| | |
|---|---|
| ***B65D 85/28*** | (2006.01) |
| ***B25H 3/04*** | (2006.01) |
| ***B25B 15/00*** | (2006.01) |
| ***B25H 3/00*** | (2006.01) |
| *A47F 7/00* | (2006.01) |

(52) U.S. Cl.

CPC ..... *B25H 3/04* (2013.01); *B25B 15/008* (2013.01); *B25H 3/003* (2013.01)

USPC ..... 206/377; 211/70.6

(58) Field of Classification Search

CPC ..... B25H 3/00; B25H 3/06; B25H 3/04; B25H 3/003; A47F 7/0035; A47F 7/0021; A47F 7/0028

USPC ..... 211/70.6, 60.1, 65–69.5, 70.3, 70.1, 211/70.7, 70.8, 71.01, 72, 73; 248/524, 248/145.6, 314; 205/372, 376, 377, 378, 205/373, 349; 206/372, 376, 377, 378, 373, 206/349

See application file for complete search history.

(56) References Cited

U.S. PATENT DOCUMENTS 360,359 A * 3/1887 Mahar ..... 211/65
953,917 A * 4/1910 Miles ..... 211/69.3

(Continued)

FOREIGN PATENT DOCUMENTS

DE 102006008225 A1 8/2007
DE 202007011375 U1 12/2007

(Continued)

OTHER PUBLICATIONS

International Search Report dated Aug. 9, 2011, as issued in corresponding International Application No. PCT/JP2011/065682, filed Jul. 8, 2011.

*Primary Examiner* — Joshua J Michener
*Assistant Examiner* — Devin Barnett
(74) *Attorney, Agent, or Firm* — Maier & Maier, PLLC

(57) ABSTRACT

To provide an L-shaped stand for hexagon socket screw keys that has a simple and compact structure, and that facilitates storage and withdrawal of the hexagon socket screw keys. An L-shaped stand for hexagon socket screw keys 11 includes: a hexagon socket screw key base 1 having a flat face for placing thereon lower ends of hexagon socket screw keys; a support portion 2 that is above the hexagon socket screw key base and that includes through-holes 2*a* provided in a line in order of sizes of the diameters of hexagon socket screw keys; and a guide 3 for aligning the orientation of hexagon socket screw keys. Preferably, a series of inclined portions are provided in the guide, and the stand is inclined by an auxiliary base 5.

11 Claims, 16 Drawing Sheets

(56) References Cited

U.S. PATENT DOCUMENTS

| | | | | | |
|---|---|---|---|---|---|
| 1,008,074 | A * | 11/1911 | Schaefer | 211/69.3 |
| 1,043,891 | A * | 11/1912 | Zange | 206/379 |
| 1,054,487 | A * | 2/1913 | Badley | 206/762 |
| 1,412,846 | A * | 4/1922 | Dietsche, Jr. | 40/539 |
| 1,474,891 | A * | 11/1923 | Burt et al. | 206/306 |
| 1,504,873 | A * | 8/1924 | Dietsche, Jr. | 40/539 |
| 1,816,057 | A * | 7/1931 | Sager | 211/69.2 |
| 1,907,435 | A * | 5/1933 | Murphy | 211/60.1 |
| 1,973,188 | A * | 9/1934 | Verderber | 211/70.6 |
| 2,278,650 | A * | 4/1942 | Drinkwater | 211/65 |
| 2,403,825 | A * | 7/1946 | Nissenbaum | 206/379 |
| 2,503,413 | A * | 4/1950 | Ressinger | 211/135 |
| 2,539,276 | A * | 1/1951 | Schmeling | 211/60.1 |
| D171,595 | S * | 3/1954 | Polan | D6/541 |
| D178,536 | S * | 8/1956 | Harriton | D6/468 |
| 2,776,744 | A * | 1/1957 | Cook | 206/377 |
| D180,106 | S * | 4/1957 | Seifert | D6/468 |
| 2,852,144 | A * | 9/1958 | Reno | 211/65 |
| 2,957,270 | A * | 10/1960 | Kennamer, Jr. | 211/69.5 |
| 2,959,296 | A * | 11/1960 | Case | 211/69.1 |
| 3,085,280 | A * | 4/1963 | Cline | 15/104.94 |
| 3,166,193 | A * | 1/1965 | Rex | 211/4 |
| 3,204,774 | A * | 9/1965 | Barbieri | 211/4 |
| 3,209,903 | A * | 10/1965 | Shiffman | 206/752 |
| 3,217,891 | A * | 11/1965 | Weaver | 211/60.1 |
| 3,236,366 | A * | 2/1966 | Broda et al. | 206/379 |
| 3,236,371 | A * | 2/1966 | Regis, Jr. et al. | 206/555 |
| 3,532,222 | A * | 10/1970 | Madden | 211/65 |
| 3,751,172 | A * | 8/1973 | Seitz et al. | 356/244 |
| 3,997,053 | A * | 12/1976 | Bondhus | 206/377 |
| 4,407,417 | A * | 10/1983 | Boyle | 211/69.1 |
| 4,561,548 | A * | 12/1985 | Call | 211/70.7 |
| 4,681,234 | A * | 7/1987 | Wisnieswski | 211/70.6 |
| 4,813,551 | A * | 3/1989 | Kuo | 211/70.6 |
| 4,817,810 | A * | 4/1989 | Shull | 220/741 |
| 4,871,074 | A * | 10/1989 | Bryson et al. | 211/26 |
| D305,777 | S * | 1/1990 | Lee | D19/85 |
| 4,993,545 | A * | 2/1991 | Feiler | 206/6.1 |
| 5,080,230 | A * | 1/1992 | Winnard | 206/350 |
| 5,097,967 | A * | 3/1992 | Sica | 211/66 |
| 5,129,528 | A * | 7/1992 | Eidsmoe et al. | 211/70.6 |
| 5,147,038 | A * | 9/1992 | Pergeau | 206/373 |
| 5,163,549 | A * | 11/1992 | Hayduchok | 206/214 |
| D343,106 | S * | 1/1994 | Eklind et al. | D6/468 |
| 5,398,823 | A * | 3/1995 | Anders | 211/70.6 |
| 5,405,024 | A * | 4/1995 | Sahf | 211/69.5 |
| 5,485,931 | A * | 1/1996 | Barr, Jr. | 211/70.6 |
| 5,544,747 | A * | 8/1996 | Horn | 206/378 |
| 5,544,764 | A * | 8/1996 | Cima | 211/60.1 |
| 5,620,092 | A * | 4/1997 | Meisinger | 206/376 |
| 5,855,285 | A * | 1/1999 | Laird et al. | 211/70.6 |
| 5,880,713 | A * | 3/1999 | Belardinelli | 345/156 |
| 5,893,457 | A * | 4/1999 | Wei | 206/373 |
| 5,938,028 | A * | 8/1999 | Hu | 206/377 |
| 6,006,906 | A * | 12/1999 | Winnard | 206/350 |
| 6,032,796 | A * | 3/2000 | Hopper et al. | 206/377 |
| 6,039,188 | A * | 3/2000 | Lee | 206/758 |
| 6,202,862 | B1 * | 3/2001 | Acquaviva et al. | 211/69.5 |
| 6,209,732 | B1 * | 4/2001 | Dennis et al. | 211/70.6 |
| 6,283,291 | B1 * | 9/2001 | Vasudeva et al. | 206/373 |
| 6,345,798 | B1 * | 2/2002 | Bondhus et al. | 248/314 |
| 6,405,865 | B1 * | 6/2002 | Lin | 206/379 |
| 6,425,489 | B1 * | 7/2002 | Cunningham | 211/70.6 |
| D470,388 | S * | 2/2003 | Levinson | D8/301 |
| RE38,905 | E * | 12/2005 | Wei | 206/373 |
| 7,036,668 | B2 * | 5/2006 | Udy | 211/70.6 |
| 7,188,726 | B2 * | 3/2007 | Lin | 206/373 |
| 7,210,578 | B2 * | 5/2007 | Tuan-Mu et al. | 206/378 |
| 7,264,118 | B2 * | 9/2007 | Chen | 206/372 |
| 7,314,142 | B2 * | 1/2008 | Lyman, Jr. | 211/69.5 |
| 7,600,640 | B2 * | 10/2009 | Hallee et al. | 206/373 |
| 7,661,526 | B2 * | 2/2010 | Lin | 206/379 |
| 7,757,867 | B2 * | 7/2010 | Hsieh | 211/70.6 |
| 7,987,975 | B1 * | 8/2011 | Lee | 206/45.23 |
| 8,152,003 | B1 * | 4/2012 | Kao | 211/70.6 |
| 8,261,911 | B2 * | 9/2012 | Lee | 206/376 |
| 8,276,767 | B2 * | 10/2012 | Su | 211/70.6 |
| 8,365,926 | B2 * | 2/2013 | Su | 211/70.6 |
| 8,511,627 | B2 * | 8/2013 | Lutze | 248/223.41 |
| 2001/0001197 | A1 * | 5/2001 | Ramsey et al. | 206/378 |
| 2001/0010291 | A1 | 8/2001 | Hu | |
| 2002/0027091 | A1 * | 3/2002 | Brown | 206/372 |
| 2003/0024837 | A1 * | 2/2003 | Chen | 206/378 |
| 2003/0116516 | A1 * | 6/2003 | Belokin et al. | 211/69.5 |
| 2004/0211737 | A1 * | 10/2004 | Siegel et al. | 211/70.7 |
| 2005/0098509 | A1 * | 5/2005 | Benn | 211/11 |
| 2005/0145587 | A1 * | 7/2005 | Matthews | 211/70.6 |
| 2005/0167379 | A1 * | 8/2005 | Hoy | 211/66 |
| 2005/0279663 | A1 * | 12/2005 | Citrigno | 206/362.1 |
| 2006/0180559 | A1 * | 8/2006 | Roberti | 211/65 |
| 2007/0012587 | A1 * | 1/2007 | Wang | 206/379 |
| 2007/0023306 | A1 * | 2/2007 | Lai | 206/372 |
| 2007/0074985 | A1 | 4/2007 | Evans | |
| 2007/0095691 | A1 * | 5/2007 | Lin | 206/378 |
| 2007/0235395 | A1 * | 10/2007 | Mondale et al. | 211/65 |
| 2007/0267368 | A1 * | 11/2007 | Pappas | 211/65 |
| 2008/0156753 | A1 * | 7/2008 | Perry | 211/68 |
| 2008/0202963 | A1 * | 8/2008 | Liao | 206/377 |
| 2008/0251476 | A1 * | 10/2008 | Shiao | 211/70.6 |
| 2008/0277296 | A1 * | 11/2008 | LaBrasca | 206/214 |
| 2009/0026155 | A1 * | 1/2009 | Bernard | 211/70.6 |
| 2009/0166305 | A1 * | 7/2009 | Hsieh | 211/70.6 |
| 2009/0200190 | A1 * | 8/2009 | Hsieh | 206/378 |
| 2009/0230065 | A1 * | 9/2009 | Wax | 211/60.1 |
| 2010/0065522 | A1 * | 3/2010 | Cheng | 211/85.8 |
| 2010/0163502 | A1 | 7/2010 | Chang | |
| 2010/0320162 | A1 * | 12/2010 | Kao | 211/70.6 |
| 2011/0031136 | A1 * | 2/2011 | Strain | 206/1.7 |
| 2012/0012485 | A1 * | 1/2012 | Wang | 206/377 |
| 2012/0214654 | A1 * | 8/2012 | Sgarabottolo | 483/16 |
| 2012/0305506 | A1 * | 12/2012 | Su | 211/70.6 |
| 2013/0098792 | A1 * | 4/2013 | Liu | 206/372 |
| 2013/0228484 | A1 * | 9/2013 | Yang | 206/349 |
| 2013/0228539 | A1 * | 9/2013 | Lin | 211/70.6 |
| 2013/0248396 | A1 * | 9/2013 | Liu | 206/372 |
| 2013/0256168 | A1 * | 10/2013 | Poillot et al. | 206/372 |
| 2013/0277258 | A1 * | 10/2013 | Lai | 206/377 |
| 2013/0306508 | A1 * | 11/2013 | Gallegos | 206/377 |

FOREIGN PATENT DOCUMENTS

| | | |
|---|---|---|
| JP | 54-136695 | 9/1979 |
| JP | 2000218573 A1 | 8/2000 |

* cited by examiner (a)

(b)

(a)

(b)

(a)

(b)

(a)

(b)

(a)

(b)

(a)

(b)

STAND FOR HEXAGON SOCKET SCREW KEYS

RELATED APPLICATIONS

This is the U.S. national stage application which claims priority under 35 U.S.C. §371 to International Patent Application No.: PCT/JP2011/065682 filed on Jul. 8, 2011, which claims priority to Japanese Patent Application No. 2010-159450 filed on Jul. 14, 2010, the disclosures of which are incorporated by reference herein their entireties.

BACKGROUND OF THE INVENTION

1. Field of the Invention

The present invention relates to a stand for L-shaped hexagon socket screw keys that facilitates storage and removal of the screw keys.

2. Description of the Related Art

In general, sizes and shapes and the like of L-shaped hexagon socket screw keys (hexagonal wrenches) are specified by standards such as, for example, JIS (Japanese Industrial Standards). A single set of hexagon socket screw keys that has one each of different-sized hexagon socket screw keys is stored in a holder that hangs from the hip or in a stand that is placed on a workbench for use or the like.

Patent Literature 1 discloses a stand for hexagon socket screw keys that can be aligned in size order and compactly stored. Patent Literature 2 discloses a holder for hexagon socket screw keys which is designed so that the hexagon socket screw keys do not overlap with each other to facilitate withdrawal and insertion of the screw keys.

[Patent Literature 1] US 2001/0010291 A

[Patent Literature 2] Japanese Patent Laid-Open No. 2000-218573

SUMMARY OF THE INVENTION

However, among the conventional stands and holders there are many that have a simple configuration but in which the hexagon socket screw keys are randomly oriented when stored and which are thus user unfriendly, or conversely, that provide good usability but include a complex mechanism in which there is a movable portion or the like, and a stand that has a simple configuration and good usability is not known.

The present invention has been made in view of the above described problem, and a principal technical object of the present invention is to provide a stand for L-shaped hexagon socket screw keys that has a simple structure and a functionally good design, and more specifically, facilitates storage and removal of L-shaped hexagon socket screw keys.

A stand for hexagon socket screw keys according to the present invention includes: a hexagon socket screw key base having a flat face for placing thereon a lower end of a hexagon socket screw key; a support portion that is above the hexagon socket screw key base and that includes through-holes arranged in a line in order of sizes of diameters of hexagon socket screw keys; and a guide for aligning an orientation of a hexagon socket screw key.

By adopting this configuration, even if the orientation of an L-shaped hexagon socket screw key to be stored is random at a time point when the hexagon socket screw key is inserted into a through-hole, because the hexagon socket screw key is freely pivotable about a handle thereof, the orientation can be aligned by the guide, and hence the hexagon socket screw key can be made easy to remove. In particular, if the stand according to the present invention is inclined at a time of storing a hexagon socket screw key or after storage thereof, since the guide functions as a stopper of rotation, the orientation of the handle of the hexagon socket screw key is aligned by means of the hexagon socket screw key's own weight.

Preferably, the guide of the stand for hexagon socket screw keys according to the present invention includes a series of inclined portions. Since a length of a handle of a hexagon socket screw key differs according to each size, it is necessary to provide a guide that corresponds to each size at a time of rotation of the handles of the hexagon socket screw keys. However, if this configuration is adopted, a guide can be constructed with a compact and simple structure, and can be caused to function as a stopper of rotation of handles of hexagon socket screw keys of respective sizes.

Preferably, the support portion of the stand for hexagon socket screw keys according to the present invention is a thick plate having a front face and a back face formed in a substantially triangular shape, and the through-holes of the stand according to the present invention are vertically provided from a top face of the support portion to a bottom face of the support portion. Thus, a reduction in weight can be achieved.

Preferably, the top face of the support portion of the stand for hexagon socket screw keys according to the present invention inclines in a front face direction. By adopting this configuration, the through-holes can be seen from the front face direction, and hence storing of hexagon socket screw keys from the front face direction is facilitated. In addition, hexagon socket screw key sizes that correspond to the respective through-holes may be written clearly in advance on the top face of the support portion.

Preferably, the through-hole of the stand for hexagon socket screw keys according to the present invention retains a long handle of the hexagon socket screw key in a manner such that the hexagon socket screw key is freely rotatable about the long handle, and also retains a center of gravity of the hexagon socket screw key. By adopting this configuration, it is possible to simply cause the handle to rotate by means of the hexagon socket screw key's own weight.

The hexagon socket screw key base of the stand for hexagon socket screw keys according to the present invention may be constituted by a plate having a side face that is formed in an L-shape. By adopting this configuration, the hexagon socket screw key base can be simply constructed. Further, it is also difficult for dust to accumulate around a lower end portion of a hexagon socket screw key.

Preferably, the hexagon socket screw key base of the stand for hexagon socket screw keys according to the present invention also includes an auxiliary base, and the auxiliary base includes a retaining portion for retaining the support portion, and a support portion for inclining and supporting the retaining portion. By adopting this configuration, when storing a hexagon socket screw key, the orientation of a handle thereof can be aligned by means of the hexagon socket screw key's own weight.

Preferably, the auxiliary base of the stand for hexagon socket screw keys according to the present invention further includes adjustment means for adjusting a retention position of the support portion. By adopting this configuration, an inclination of the stand for hexagon socket screw keys according to the present invention can be adjusted by adjustment means.

Preferably, the support portion of the auxiliary base of the stand for hexagon socket screw keys according to the present invention forms a space for inserting a retaining portion of another auxiliary base, the retaining portion of the auxiliary base of the stand for hexagon socket screw keys according to the present invention includes an insertion portion for inserting into another auxiliary base, and the stand for hexagon socket screw keys is configured so that, when aligning auxiliary bases together, the insertion portion of one of the auxiliary bases is inserted into the space of another of the auxiliary bases. By adopting this configuration, more space can be saved in comparison to when auxiliary bases are aligned individually.

According to the stand for hexagon socket screw keys of the present invention, since hexagon socket screw keys of respective sizes are made freely rotatable about the respective handles thereof, and the guide serves as a stopper of the rotation thereof, hexagon socket screw keys can be stored in a manner in which the orientations of the handles of the hexagon socket screw keys are aligned by the guide.

BRIEF DESCRIPTION OF THE DRAWINGS

FIGS. 2A and 2B are views showing the stand for hexagon socket screw keys according to the first embodiment, in which FIG. 2A is a plan view as seen from above, and FIG. 2B is a front view as seen from a front face;

FIGS. 3A and 3B are views showing the stand for hexagon socket screw keys according to the first embodiment, in which FIG. 3A is a right side view as seen from the right side when facing the front face, and FIG. 3B is a left side view as seen from the left side when facing the front face;

FIGS. 6A and 6B are views showing the auxiliary base of the stand for hexagon socket screw keys according to the second embodiment, in which FIG. 6A is a plan view as seen from above, and FIG. 6B is a front view as seen from a front face;

FIGS. 7A and 7B are views showing the auxiliary base of the stand for hexagon socket screw keys according to the second embodiment, in which FIG. 7A is a right side view as seen from the right side when facing the front face, and FIG. 7B is a left side view as seen from the left side when facing the front face;

FIGS. 9A and 9B are views illustrating the manner in which hexagon socket screw keys are stored in the stand for hexagon socket screw keys, in which FIG. 9A is a perspective view illustrating a state immediately after a hexagon socket screw key has been inserted in a through-hole, and FIG. 9B is a perspective view illustrating a state after storing of the hexagon socket screw key;

FIGS. 13A and 13B are views showing an example of a through-hole constituted by a plate material that has been subjected to a burring process and a pipe, in which FIG. 13A is a perspective view showing a configuration example of a through-hole, and FIG. 13B is a view of the through-hole as seen from a front face;

DETAILED DESCRIPTION OF THE PREFERRED EMBODIMENTS

The following description is intended to describe embodiments of the present invention in detail, and is not to be used to restrictively interpret the respective inventions described in the accompanying claims.

(First Embodiment)

—Hexagon Socket Screw Key—

Figure 1:
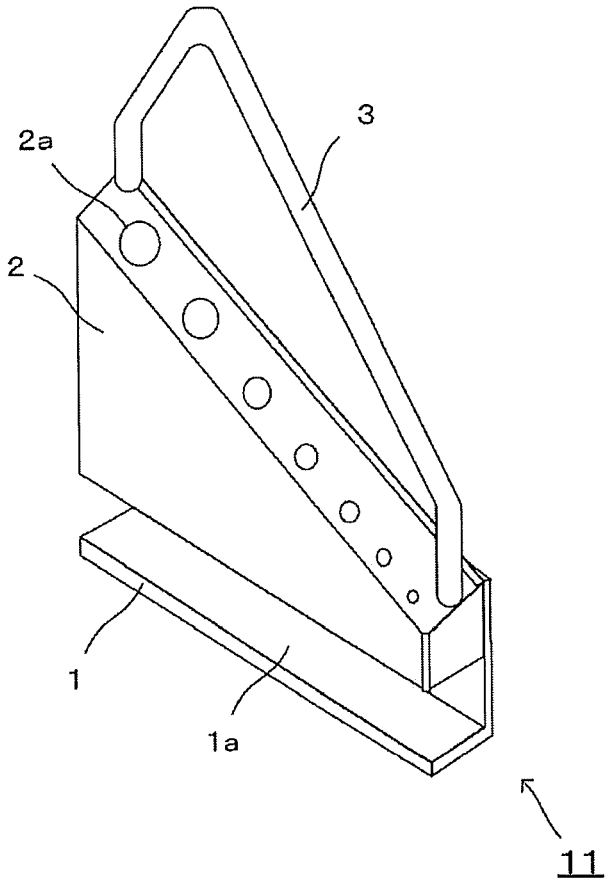
FIG. 1 is a perspective view showing a stand for hexagon socket screw keys according to a first embodiment.
Figure 2:
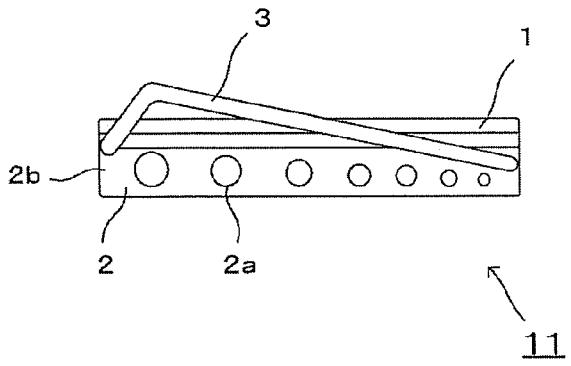
Figure 2:
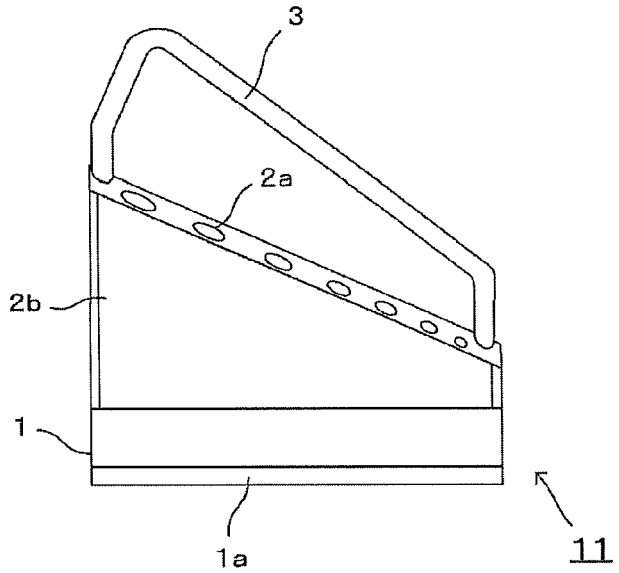
Figure 3:
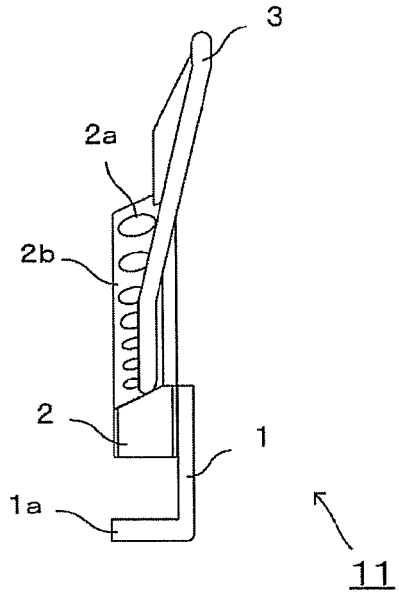
Figure 3:
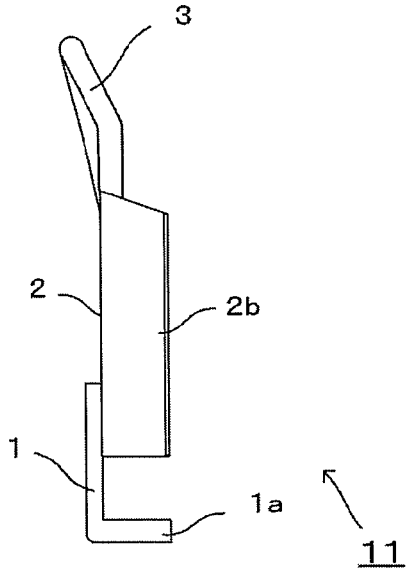

FIG. 1 is a perspective view showing a stand for hexagon socket screw keys according to a first embodiment. FIGS. 2A and 2B are views showing the stand for hexagon socket screw keys according to the first embodiment, in which FIG. 2A is a plan view as seen from above, and FIG. 2B is a front view as seen from a front face. FIGS. 3A and 3B are views showing the stand for hexagon socket screw keys according to the first embodiment, in which FIG. 3A is a right side view as seen from the right side when facing the front face, and FIG. 3B is a left side view as seen from the left side when facing the front face.

As shown in these drawings, a stand for hexagon socket screw keys 11 of the first embodiment includes a hexagon socket screw key base 1 that has a bottom plate portion la, a support portion 2 that has through-holes 2*a*, and a guide 3. For example, metal such as iron or aluminum, stainless steel, an alloy, a resin, a ceramic or the like can be used as the material of the respective portions of the stand for hexagon socket screw keys. The hexagon socket screw key base 1, the support portion 2 and the guide 3 that are the respective portions of the stand for hexagon socket screw keys 11 are connected by welding or by screws and fasteners or other connection means.

As shown in FIG. 2A, the cross-section of each through-hole 2*a* is a round shape for inserting a hexagon socket screw key, and the through-holes 2*a* are perpendicularly provided with respect to a bottom face of a thick plate 2*b* in an order in accordance with the sizes of the respective hexagon socket screw keys. The number of through-holes 2*a* can be appropriately changed according to the number of hexagon socket screw keys to be stored, and the size of the support portion 2 may also be changed in accompaniment therewith. It is sufficient for the sizes of the through-holes 2*a* to be such that there is a clearance of a degree such that the respective hexagon socket screw keys can freely rotate around the through-holes 2*a* when the hexagon socket screw keys are inserted.

As shown in FIG. 2B, the front face of the support portion 2 is constituted by a thick plate 2*b* that is a substantially triangular shape and that includes the through-holes 2*a* that pass through to the bottom face from the top face thereof. Preferably, the depths of the through-holes 2*a* lengthen in proportion to the sizes of the hexagon socket screw keys. This is because, by adopting this configuration, the support portion 2 becomes compact and the hexagon socket screw keys can be stably retained in the through-holes 2*a*. Preferably, the through-holes 2*a* retain the center of gravity of the hexagon socket screw keys of each size. This is because it is thereby difficult for the hexagon socket screw keys to fall over, and it is easy for the hexagon socket screw keys to rotate within the through-holes 2*a*.

As shown in FIG. 2B, the top face of the thick plate 2*b* is inclined so that the through-holes 2*a* can be diagonally viewed from the front. In contrast, the bottom face of the thick plate 2*b* is flat. The guide 3 is connected to both ends of the top face of the thick plate 2*b*. A back face of the support portion 2 is joined to an upper portion of the front face of the hexagon socket screw key base 1 so that the bottom face of the thick plate 2*b* becomes parallel with the bottom plate portion 1*a* of the hexagon socket screw key base 1.

The guide 3 is joined to both ends of the top face of the support base 2 by bending a bar so that the guide 3 can guide short handles of hexagon socket screw keys that have been inserted into the through-holes 2*a*. At a time of storing hexagon socket screw keys, when the hexagon socket screw keys are inserted into the through-holes 2*a* while directing the short handles thereof towards the guide 3, the short handles of the hexagon socket screw keys are guided by the guide and aligned in one direction, and are supported in that state. Thus, since the directions of the short handles of the hexagon socket screw keys are supported in a state in which the short handles are aligned in an orderly manner in one direction by the guide 3, the hexagon socket screw keys have an aesthetically pleasing appearance and are also easy to remove.

Preferably, the height and depth of the guide 3 are adjusted according to the sizes of the respective hexagon socket screw keys to be guided. More specifically, for example, as shown in FIG. 2A and FIG. 2B, the guide 3 is bent so that, as the sizes of the hexagon socket screw keys to be guided and supported increase, the height and depth of the guide 3 also increase to correspond thereto. As long as the guide 3 is a member that fulfills such a function, the guide 3 is not limited to a bar, and for example, may be constructed by bending a thin plate material.

As shown in FIGS. 3A and 3B, the shape of a side face of the hexagon socket screw key base 1 is a substantially L-shape that takes the bottom plate portion la as one side. The lower ends of hexagon socket screw keys are placed on the top face of the bottom plate portion 1*a*. The bottom face of the bottom plate portion 1*a* is a supporting surface. When this shape is adopted, dust does not gather around the lower ends of the hexagon socket screw keys.

Note that, the support portion 2 is not limited to a member in which the through-holes 2*a* are provided in the thick plate 2*b* as described above, and for example, the support portion 2 may be constructed by combining a thin plate and pipes, or may be constructed using other members. When using a thin plate and pipes, the support portion 2 may be constructed by cutting those members into predetermined shapes and executing a burring process or folding process or the like in accordance with necessity, and thereafter assembling the relevant members and joining the members by welding or using a connecting member or the like.

Figure 13:
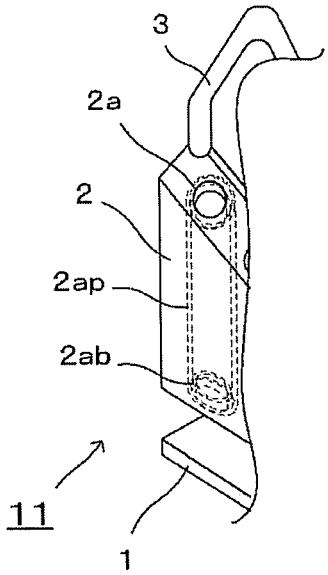
Figure 13:
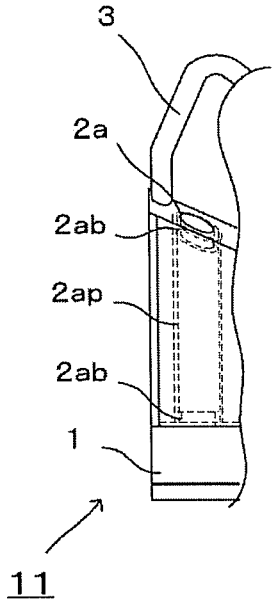

FIGS. 13A and 13B are view showing an example of a through-hole constituted by a plate material that has been subjected to a burring process and a pipe. FIG. 13A is a perspective view showing a configuration example of the through-hole, and FIG. 13B is a view of the through-hole as seen from a front face. As shown in these drawings, the top face and the bottom face of the support portion 2 are constituted by a thin plate material, and a hole 2*ab* having a height in the bottom face direction and a hole 2*ab* having a height in the top face direction are formed in the top face and the bottom face, respectively, by a burring process. The through-hole 2*a* is formed by inserting a pipe member 2*ap* into these holes. Note that, although only one part of the stand for hexagon socket screw keys is shown in FIG. 13A and FIG. 13B and the remaining structure is omitted, other through-holes are formed in a similar manner.

Figure 4:
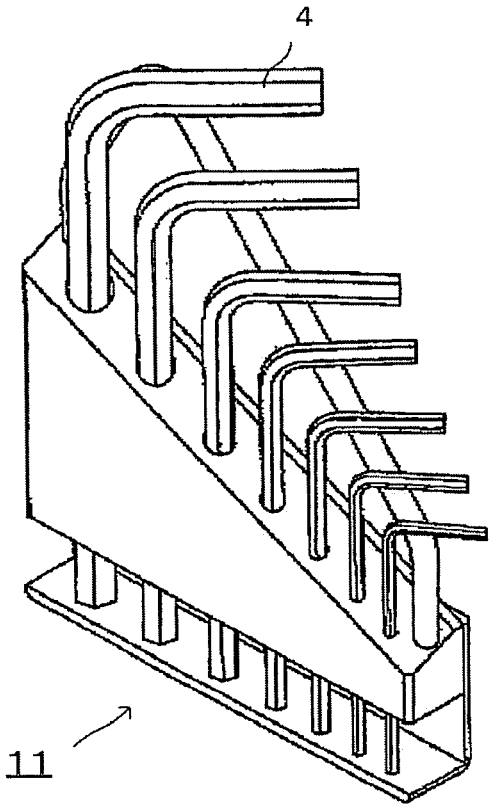
FIG. 4 is a view showing the stand for hexagon socket screw keys according to the first embodiment in which hexagon socket screw keys have been stored.

FIG. 4 is a view showing the stand for hexagon socket screw keys according to the first embodiment in which hexagon socket screw keys have been stored. As shown in FIG. 4, the hexagon socket screw keys are stored in a manner in which the orientations of the respective short handles thereof are aligned in a predetermined direction by the guide 3. Consequently, the stored state of the hexagon socket screw keys is aesthetically pleasing in appearance and the hexagon socket screw keys are also easy to remove. In particular, even when removing a small-sized hexagon socket screw key or when there is a short distance between adjacent hexagon socket screw keys, the desired hexagon socket screw key can be easily removed without contacting an adjacent hexagon socket screw key by rotating the desired hexagon socket screw key with a finger and picking up and pulling out the hexagon socket screw key.

For safety, preferably the corners of the hexagon socket screw key base 1 and the support portion 2 are chamfered, rounded, or made polygonal. In addition, both ends of the through-hole 2*a* may also be chamfered or the like.

Note that the respective portions of the stand for hexagon socket screw keys may also be subjected to plating or surface treatment for the purpose of rust prevention, for reinforcement of contact portions that contact with the hexagon socket screw keys, or to reduce friction and the like.

(Second Embodiment)

According to a second embodiment, a stand for hexagon socket screw keys is described that further includes an auxiliary base for inclining and retaining the stand itself.

Figure 5:
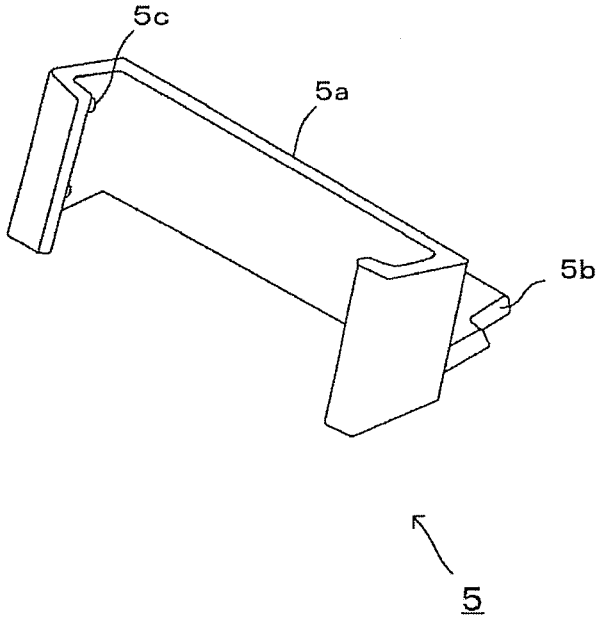
FIG. 5 is a perspective view showing an auxiliary base of the stand for hexagon socket screw keys according to a second embodiment.
Figure 6:
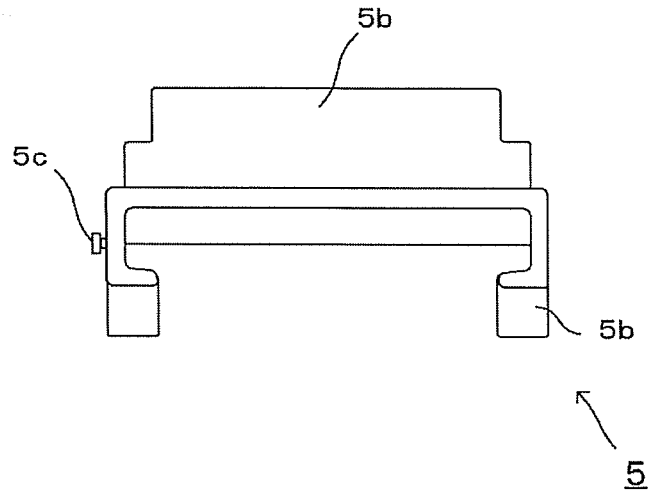
Figure 6:
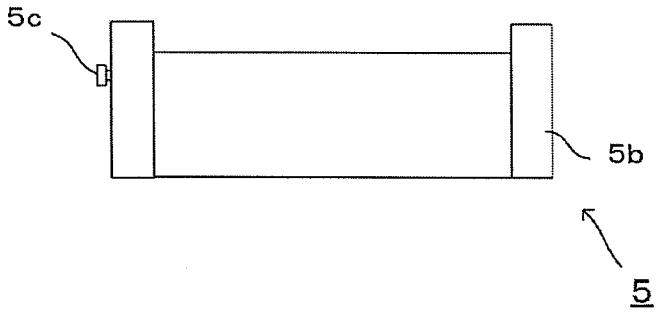
Figure 7:
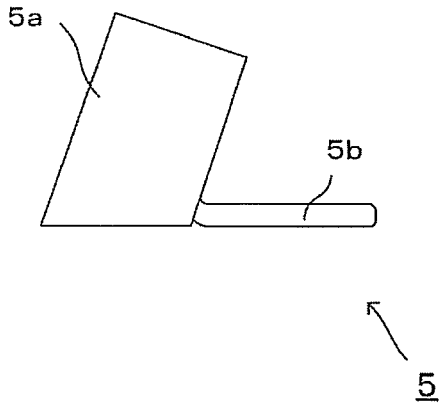
Figure 7:
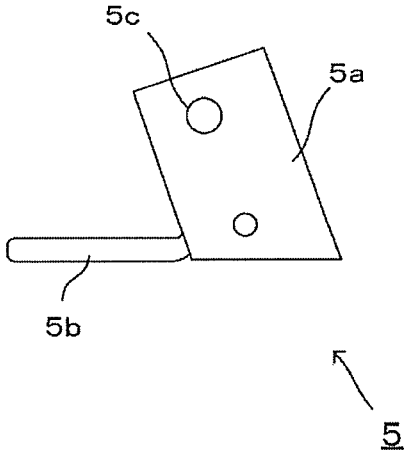

FIG. 5 is a perspective view showing an auxiliary base of the stand for hexagon socket screw keys according to the second embodiment. FIGS. 6A and 6B are views showing the auxiliary base of the stand for hexagon socket screw keys according the second embodiment, in which FIG. 6A is a plan view as seen from above, and FIG. 6B is a front view as seen from a front face. FIGS. 7A and 7B are views showing the auxiliary base of the stand for hexagon socket screw keys according to the second embodiment, in which FIG. 7A is a right side view as seen from the right side when facing the front face, and FIG. 7B is a left side view as seen from the left side when facing the front face. The auxiliary base 5 includes a stand retaining portion 5*a*, a bottom plate portion 5*b*, and retention position adjustment means (adjuster) 5*c*. The stand retaining portion 5*a* is formed in a shape that can cover the outer circumference of the stand for hexagon socket screw keys according to FIG. 1. The bottom plate portion 5*b* abuts against the stand retaining portion 5*a* at a predetermined inclination angle with respect thereto. The retention position adjustment means 5*c* includes screws and threaded holes, and screws that pass through threaded holes at two locations push against the inside surface of the stand retaining portion 5*a* and fix the stand.

The auxiliary base 5 is easily obtained by processing a plate material to form the stand retaining portion 5*a* part, the bottom plate portion 5*b* part, and the threaded holes of the retention position adjustment means 5*c* and the like, and bending and welding the aforementioned parts or the like. A material that is the same as the material used for the stand for hexagon socket screw keys may also be used for the auxiliary base 5. Further, similarly to the stand for hexagon socket screw keys, the corners of the auxiliary base 5 may be chamfered, and plating or surface treatment or the like of each part of the auxiliary base 5 may be performed.

In this connection, in the stand for hexagon socket screw keys, instead of the auxiliary base, through-holes may be provided at an inclination with respect to the supporting surface, or an inclining mechanism such as an inclining support portion that causes the stand to incline may be provided.

Note that, the respective portions of the stand for hexagon socket screw keys may also be subjected to plating or surface treatment to prevent rust or the like, and to reinforce contact portions that contact with the hexagon socket screw keys or reduce friction.

Figure 8:
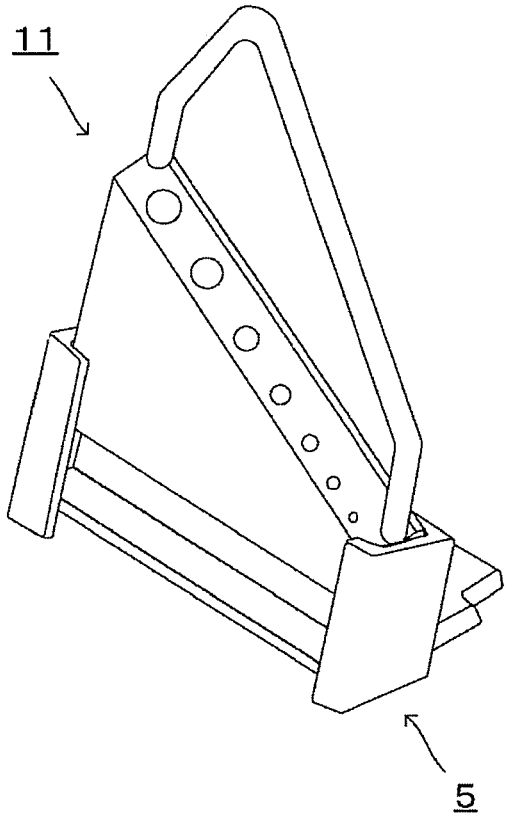
FIG. 8 is a perspective view showing a state in which the stand for hexagon socket screw keys is retained in the auxiliary base.

FIG. 8 is a perspective view showing a state in which the stand for hexagon socket screw keys is retained in the auxiliary base. As shown in FIG. 8, the stand for hexagon socket screw keys 11 is retained by the auxiliary base 5 and inclines. The stand for hexagon socket screw keys 11 is fixed to the auxiliary base 5 by screws of the retention position adjustment means 5*c* that are not shown.

Figure 9:
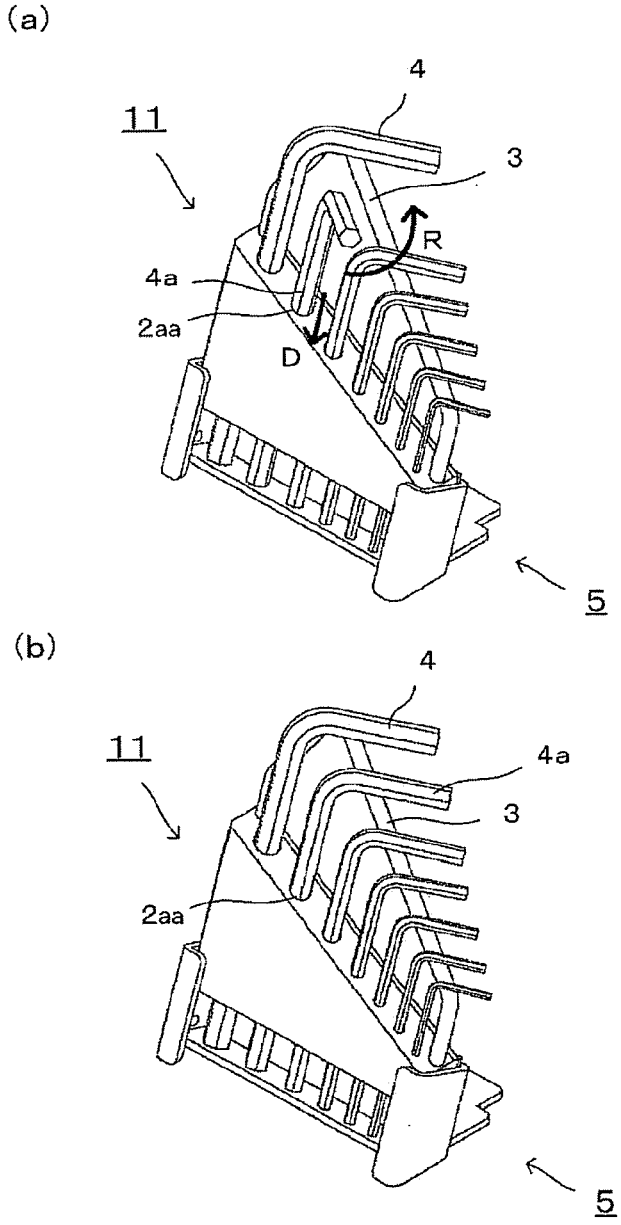

FIG. 9A and FIG. 9B are views that illustrate the manner in which hexagon socket screw keys are stored in the stand for hexagon socket screw keys. FIG. 9A is a view illustrating a state immediately after a hexagon socket screw key has been inserted in a through-hole, and FIG. 9B is a view illustrating a state after storing of the hexagon socket screw key. As shown in FIG. 9A, when a hexagon socket screw key 4*a* is inserted into a through-hole 2*aa* with a short handle thereof facing frontward, the hexagon socket screw key 4*a* advances in the direction D under its own weight until the lower end thereof contacts the bottom plate portion, and furthermore, rotates in the direction of R in a manner that takes the through-hole 2*aa* as an axis. The orientation of the handle is aligned as a result of the rotation stopping when the hexagon socket screw key 4*a* contacts the guide 3.

Figure 10:
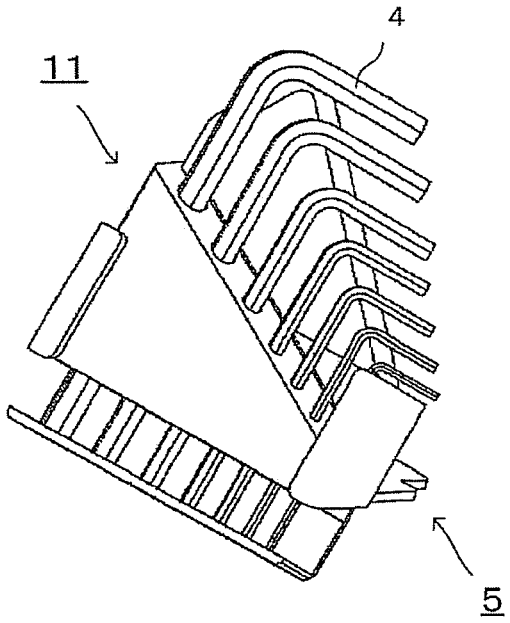
FIG. 10A is a perspective view showing a state in which a retention position of the stand for hexagon socket screw keys has been changed.
FIG. 10B is a side view illustrating a state in which the retention position of the stand for hexagon socket screw keys has been changed.
Figure 10:
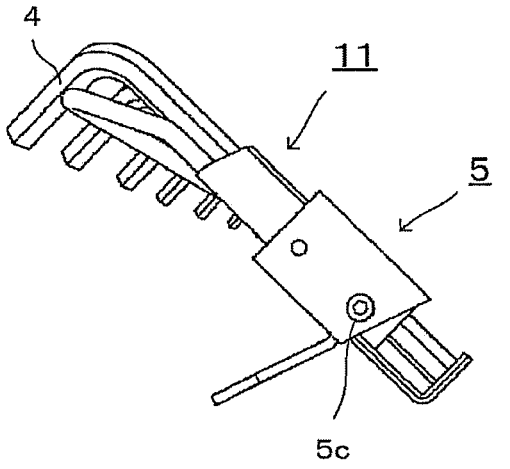

FIG. 10A and FIG. 10B are views that illustrate a state in which a retention position of the stand for hexagon socket screw keys has been changed, in which FIG. 10A is a perspective view as seen from in front of the front face of the stand for hexagon socket screw keys, and FIG. 10B is a side view as seen from the left side when facing the front face. In the stand for hexagon socket screw keys 11, the auxiliary base 5 is retained at a middle part of the stand by the retention position adjustment means 5*c*. As shown in FIG. 10B, the inclination of the stand for hexagon socket screw keys 11 can be adjusted at a position at which the retention position adjustment means 5*c* of the auxiliary base 5 is retained on the stand 11.

(Third Embodiment)

Figure 11:
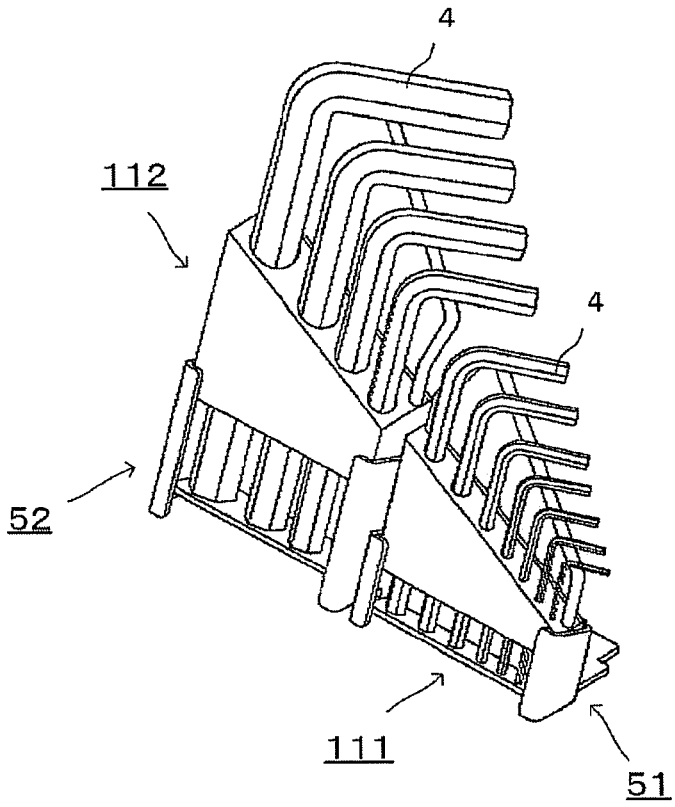
FIG. 11 is a view showing a state in which stands for hexagon socket screw keys that are equipped with an auxiliary base are arranged in one row.

FIG. 11 illustrates an example in which a set of stands for hexagon socket screw keys 111 and 112 constructed by dividing a stand for hexagon socket screw keys into two parts are arranged in one row. When a stand for hexagon socket screw keys is divided into two parts in this manner, it is easy to carry the stands because the respective stands 111 and 112 can be made compact. Further, in the two stands for hexagon socket screw keys 111 and 112, a connection portion may be provided in each of the stands 111 and 112 or in auxiliary bases 51 and 52, and the stands 111 and 112 may be joined together to form a single unit by being connected to each other at the connection portions.

Figure 12:
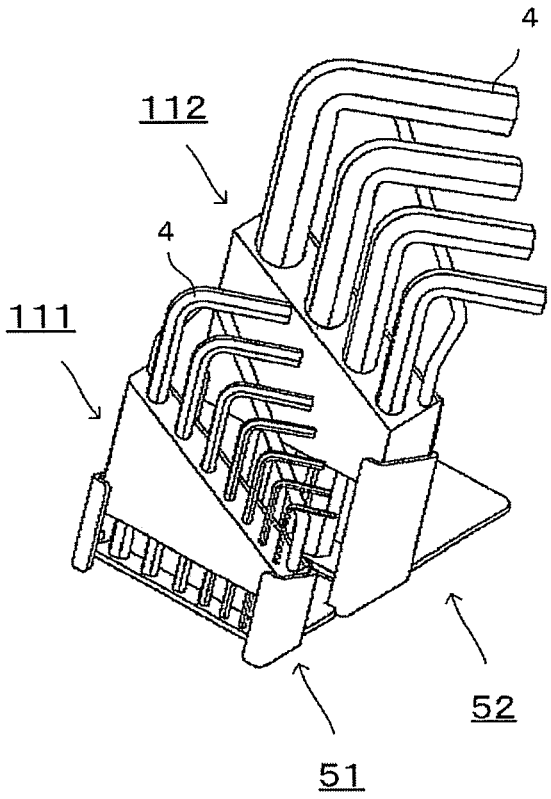
FIG. 12 is a view showing a state in which stands for hexagon socket screw keys that are equipped with an auxiliary base are arranged in two rows.

FIG. 12 is a view showing a state in which two stands for hexagon socket screw keys that are each equipped with an auxiliary base are arranged in two rows. As shown in FIG. 12, the two stands for hexagon socket screw keys 111 and 112 may be arranged in two rows, and one set of hexagon socket screw keys 4 may be divided in two and stored therein. Since a distal end of the bottom plate portion of the auxiliary base 51 is formed as a substantially convex portion, as shown in FIG. 6A, so as to be insertable into an empty space at the front face of the auxiliary base 52, there is the advantage that a space in which the stands for hexagon socket screw keys 111 and 112 are arranged in as shown in FIG. 12 is less than a space that is required when arranging each of the stands 111 and 112 independently.

(Fourth Embodiment)

Figure 14:
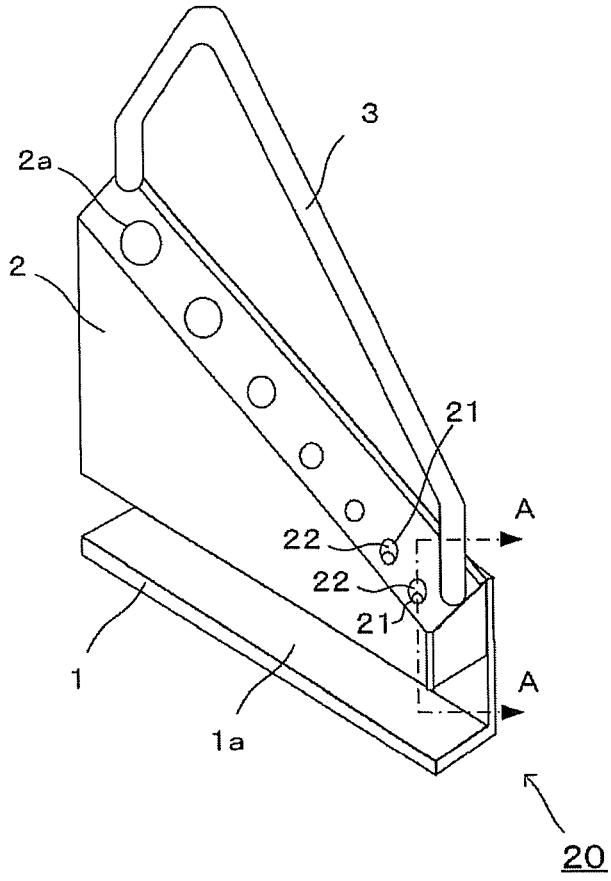
FIG. 14 is a perspective view showing a stand for hexagon socket screw keys according to a fourth embodiment.

FIG. 14 is a perspective view showing a stand for hexagon socket screw keys according to a fourth embodiment. The same reference symbols are used for components that are the same as in the stand for hexagon socket screw keys according to the first embodiment. As shown in FIG. 14, a tapered portion 22 is provided at an upper end portion of through-holes 21 of a stand for hexagon socket screw keys 20.

Figure 15:
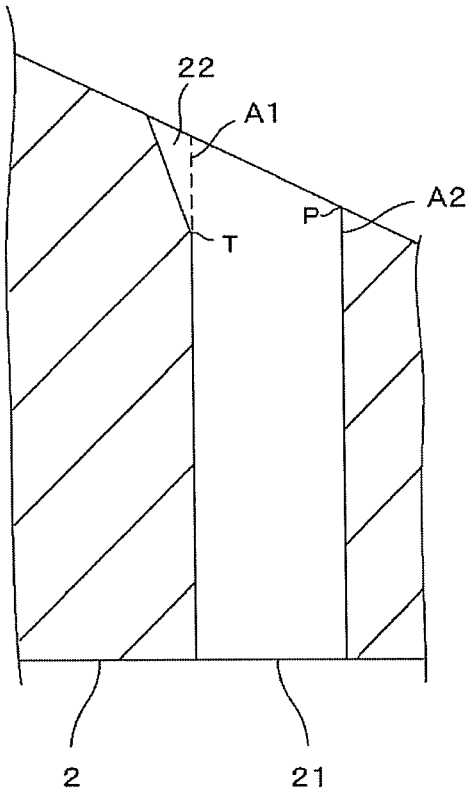
FIG. 15 is a view showing a through-hole that has a tapered portion.
Figure 16:
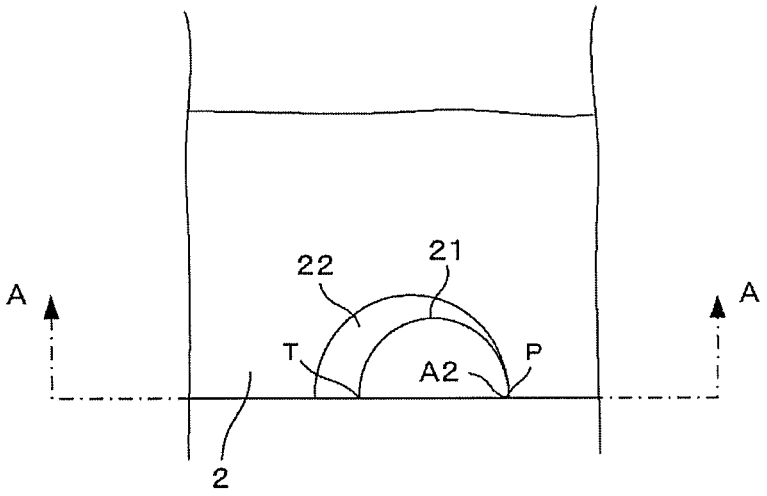
FIG. 16 is a view of a cross-section of a through-hole that has a tapered portion as seen from above.

FIG. 15 is a view showing a through-hole that has a tapered portion, that is an enlarged cross-sectional view along a line A-A in FIG. 14 as seen in the direction of the arrows. A dashed line inside the through-hole indicates a portion Al prior to performing a tapering process on the through-hole. FIG. 16 is a view, as seen from above, of a cross-section of a through-hole that has a tapered portion. Note that, a guide and detailed parts are omitted from FIG. 15 and FIG. 16.

As is clear from FIG. 15 and FIG. 16, the tapered portion 22 is provided to widen the entrance of the through-hole, and the diameter of the through-hole is larger at the upper end portion thereof than at the lower end portion. As a result, insertion of a hexagon socket screw key into the through-hole can be facilitated. In particular, since the hole diameter of a through-hole corresponding to a small-size hexagon socket screw key is also small and insertion of the hexagon socket screw key is difficult, ease of use is enhanced further by widening the entrance of the through-hole in this manner.

Note that, it is preferable to provide a lower end T of the tapered portion 22 at a position that is lower than an upper end portion P of the through-hole 21. This is because, as a result, when a hexagon socket screw key is inserted into the through-hole 21 while being slid along the tapered portion 22 of the widened through-hole, the hexagon socket screw key will definitely strike against a wall A2 on the opposite side, and hence the hexagon socket screw key can be easily inserted even without visually identifying the part that the hexagon socket screw key strikes. Further, as described in the first embodiment and the like, after the hexagon socket screw key is inserted into the through-hole 21, the guide 3 can align the orientation of the short handle of the hexagon socket screw key in a predetermined direction.

Although in FIG. 14 the tapered portion 22 is provided in two through-holes in order from a side on which the through-hole with the smallest diameter is provided, the tapered portion 22 can be provided in an arbitrary through-hole. Further, the surface of the tapered portion 22 may be a curved surface or a stepped surface, and surface treatment may be performed to facilitate sliding of a hexagon socket screw key. A shape that appears at the top end face of the tapered portion 22 may be not only a substantially round shape, but the shape may be one of a variety of shapes such as a rectangular shape or a shape in which one part is curved. Since it is good to appropriately adjust a taper angle of the tapered portion 22 in accordance with the through-hole 21, the taper angle is not limited to the taper angle shown in the drawings. For example, the lower end T of the tapered portion 22 may be provided at the lower end of the through-hole.

According to the present invention, an L-shaped stand for hexagon socket screw keys that is easy to use can be obtained that has a simple structure and that facilitates storing and withdrawing of hexagon socket screw keys, and thus working efficiency at a work site can be significantly improved. Accordingly, the present invention has an extremely high degree of industrial applicability.

What is claimed is:

1. A stand with at least one L-shaped hexagon socket screw key, comprising:

a hexagon socket screw key base having a flat face and receiving thereon a lower end of at least one hexagon socket screw key;

a support portion that is above the hexagon socket screw key base that includes through-holes arranged in a line in order of sizes of diameters of hexagon socket screw keys, wherein, when in use the through-holes retain a long handle of the at least one hexagon socket screw key in a manner such that the at least one hexagon socket screw key is freely rotatable within the through holes about the long handle; and a guide that extends upwardly from a top face of the support portion that is used to align an orientation of the least one L-shaped hexagon socket screw key, the guide comprises a series of inclined portions and opposing first and second end portions, wherein the first end portion is attached to a rear portion of the top face and the second end portion is attached to a generally midsection portion of the top face that is offset from the rear portion of the top face; wherein when the stand is inclined, the at least one socket screw key rotates under its own weight and the guide stops a rotation of a short handle of the at least one hexagon socket screw key to align the short handle in a single direction above the guide.

2. The stand with at least one L-shaped hexagon socket screw key according to claim 1, wherein:

the support portion is a thick plate having a front face and a back face formed in a substantially triangular shape; and the through-holes are vertically provided from the top face of the support portion to a bottom face of the support portion.

3. The stand with at least one L-shaped hexagon socket screw key according to claim 2, wherein the top face of the support portion inclines in a front face direction.

4. The stand with at least one L-shaped hexagon socket screw key according to claim 1, wherein the through-holes further:

retain a center of gravity of the at least one hexagon socket screw key.

5. The stand with at least one L-shaped hexagon socket screw key according to claim 1, wherein the screw key base comprises a plate having a side face that is formed in an L-shape.

6. The stand with at least one L-shaped hexagon socket screw key according to claim 1, further comprising an auxiliary base, wherein the auxiliary base comprises:

a stand retaining portion for retaining the support portion; and a bottom plate for inclining and supporting the stand retaining portion.

7. The stand with at least one L-shaped hexagon socket screw key according to claim 6, wherein the auxiliary base further comprises:

adjustment means for adjusting a retention position of the support portion.

8. The stand with at least one L-shaped hexagon socket screw key according to claim 6, wherein:

the bottom plate portion forms a space for inserting the stand retaining portion of another auxiliary base;

the stand retaining portion comprises an insertion portion for inserting into another auxiliary base; and when aligning auxiliary bases together, the insertion portion of one of the auxiliary bases is inserted into the space of another of the auxiliary bases.

9. The stand with at least one L-shaped hexagon socket screw key according to claim 1, wherein:

a diameter of the through-hole is greater at an upper end portion than at a lower end portion.

10. The stand for hexagon socket screw keys according to claim 9, wherein the through-hole has a tapered portion at one part of an upper end portion.

11. The stand with at least one L-shaped hexagon socket screw key according to claim 1, wherein:

a lower end of the tapered portion is at a lower position than the upper end portion.

* * * * *